US007650108B2

(12) United States Patent
Yamamoto et al.

(10) Patent No.: US 7,650,108 B2
(45) Date of Patent: Jan. 19, 2010

(54) IMAGE FORMING APPARATUS

(75) Inventors: Kenji Yamamoto, Tokyo (JP); Satoshi Sakata, Tokyo (JP); Kazumichi Yamauchi, Tokyo (JP); Akira Okamoto, Tokyo (JP); Kazutoshi Yoshimura, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 250 days.

(21) Appl. No.: 11/933,563

(22) Filed: Nov. 1, 2007

(65) Prior Publication Data

US 2008/0107433 A1 May 8, 2008

(30) Foreign Application Priority Data

Nov. 8, 2006 (JP) ..... 2006-302583

(51) Int. Cl.
*G03G 15/00* (2006.01)

(52) U.S. Cl. ..... 399/389

(58) Field of Classification Search ..... 399/45, 399/81, 389, 407
See application file for complete search history.

(56) References Cited

U.S. PATENT DOCUMENTS 5,722,029 A * 2/1998 Tomidokoro et al. ..... 399/389
6,674,981 B2 * 1/2004 Sugimoto ..... 399/81
6,690,911 B2 * 2/2004 Yamagishi ..... 399/389 X
6,795,664 B2 * 9/2004 Sugimoto ..... 399/81
2006/0110177 A1 * 5/2006 Ushio et al. ..... 399/81

FOREIGN PATENT DOCUMENTS

JP 8-245003 9/1996
JP 11-225247 8/1999

* cited by examiner

*Primary Examiner*—Sandra L Brase
(74) *Attorney, Agent, or Firm*—Cantor Colburn LLP

(57) ABSTRACT

An image forming apparatus for use with a transfer sheet includes: a sheet feeding unit structured to feed the transfer sheet; a color detection sensor structured to detect color information on the transfer sheet fed from the sheet feeding unit; a recognition section structured to recognize whether the transfer sheet subjected to the detection by the color detection sensor is a non-tabbed transfer sheet having no tab, or either a tabbed transfer sheet having a tab or an unprocessed tabbed transfer sheet blank, the unprocessed tabbed transfer sheet blank being capable of being processed into a tabbed transfer sheet having a tab by post-processing, wherein a recognition result is made based on the color information detected by the color detection sensor; and a control section that controls image forming on and conveying of the fed transfer sheet, according to the recognition result by the recognition section.

13 Claims, 9 Drawing Sheets

NOTE: TAB TRANSFER SHEET REPRESENTS " TABBED TRANSFER SHEET " AND " UNPROCESSED TABBED TRANSFER SHEET BLANK " IN STEPS S8 AND S10.

NOTE: TAB TRANSFER SHEET REPRESENTS " TABBED TRANSFER SHEET " AND " UNPROCESSED TABBED TRANSFER SHEET BLANK " IN STEPS S8 AND S10.

FIG. 7 (a) UNPROCESSED TABBED TRANSFER SHEET BLANK (BEFORE POST-PROCESSING)
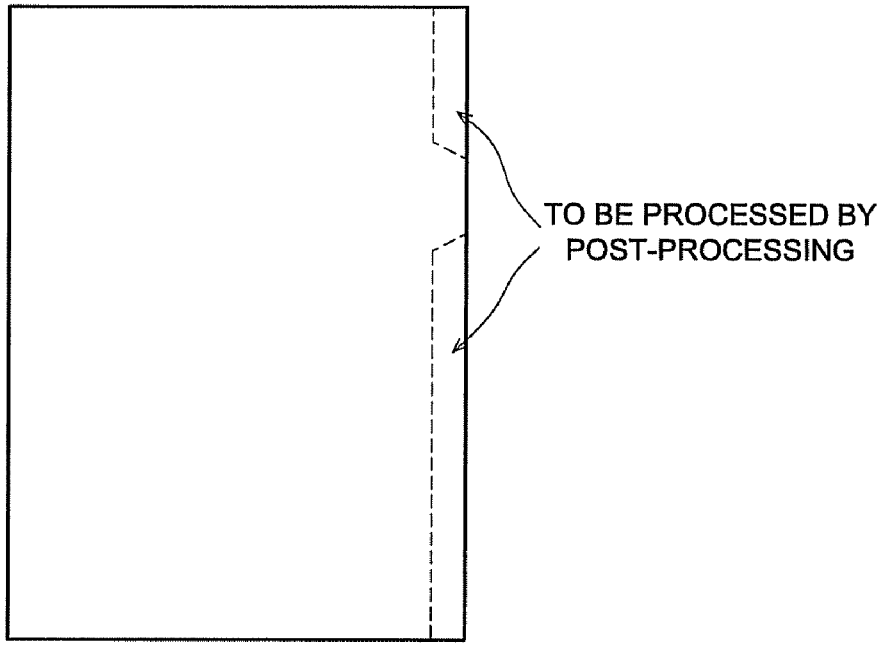
FIG. 7 (b) TABBED TRANSFER SHEET (RESULT OF POST-PROCESSING ON UNPROCESSED TABBED TRANSFER SHEET BLANK)
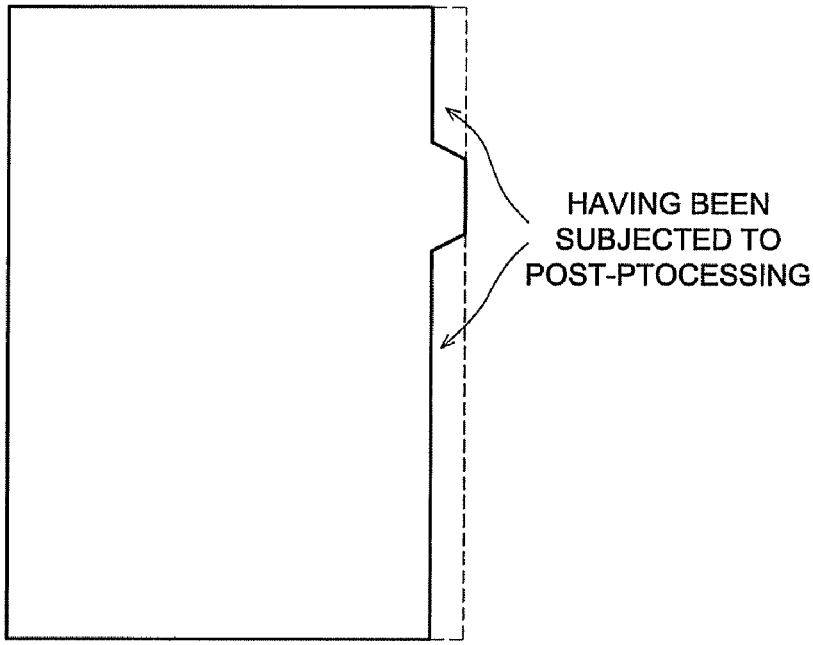

IMAGE FORMING APPARATUS

FIELD OF THE INVENTION

The present invention relates to an image forming apparatus, such as a copier and printer, and particularly relates to an image forming apparatus that allows using transfer sheets having a tab (tabbed transfer sheets) or unprocessed tabbed transfer sheet blanks being capable of being processed into transfer sheets having a tab by post-processing.

BACKGROUND OF THE INVENTION

Transfer sheets having a tab (tabbed transfer sheets) have been used for various image forming apparatuses, such as copiers and printers.

FIG. 4 illustrates tabbed transfer sheets arranged between non-tabbed transfer sheets having no tab In FIG. 4, seven transfer sheets are aligned, wherein the third transfer sheet from the front (X in FIG. 4), and the fifth transfer sheet (Y in FIG. 4) are "tabbed transfer sheets".

Further, in FIG. 4, the protrusion x of the third transfer sheet from the front (X in FIG. 4) is a tab, and the protrusion y of the fifth transfer sheet from the front (Y in FIG. 4) is a tab. In FIG. 5, L represents the tab length and W represents the tab width. In FIG. 4, the tabs x and y are arranged at different positions, with respect to the longitudinal side of the transfer sheets, which are the tab positions.

Further, FIGS. 6*a* to 6*d* show examples of types of tabs. The tabs shown in FIG. 6*a* have the same tab width, and different tab lengths (pattern A). The tabs are formed in shapes which divide the side, of the transfer sheets, provided with the tabs into three parts (3 tabs). That is, the number of division in this case is three.

Tabs (pattern A), shown in FIG. 6*b*, having the same tab width and different tab lengths are formed in shapes (four tabs) which divide the side of the transfer sheets provided with the tabs into four parts. That is, the number of division is four in this case.

Tabs (pattern B), shown in FIG. 6*c*, having the same tab width and length and different positions (tab positions) where the tabs are provided, are formed in shapes (three tabs) which divide the side of the transfer sheets provided with the tabs into three parts. That is, the number of division is three in this case.

Further, tabs (pattern B), shown in FIG. 6*d*, having the same tab width and tab length and different positions (tab positions) provided with the tabs, are formed in shapes (four tabs) which divide the side provided with the tabs into four parts. That is, the number of division is four in this case.

Incidentally, even when the pattern of tabbed transfer sheets is the same, and the above number of division is also the same for example, since the tab positions, tab lengths, or tab widths are different, a conventional image forming apparatus is incapable of detecting tab positions.

Further, in order to prevent image forming from extending out into a tab area, it was necessary to set tab sheets on a sheet feeding cassette in a state that the tab positions are correct. In fact, regarding image forming on a tab area, it was impossible to confirm the state without actually forming an image.

Further, since tabbed transfer sheets are intended to be inserted as inter-sheets, it is necessary to set tabbed transfer sheets on a sheet feeding cassette in an insertion order such that the tab positions are correct. In other words, when tabbed transfer sheets are set with a wrong insertion order with respect to tab positions, tabbed transfer sheets with desired tab positions are not inserted, which does not allow even detecting the state.

For image forming apparatuses that handle these types of tabbed transfer sheets, offers have been made regarding tab detection and control of sheet feeding timing in the following Patent Documents 1 and 2, and others.

Patent Document 1: Japanese Patent Application Publication TOKKAI No. H11-225247 (page 1, FIG. 1)

Patent Document 2: Japanese Patent Application Publication TOKKAI No. H8-245003 (page 1, FIG. 1)

According to inventions disclosed in the above Patent Documents, it is possible to perform tab detection and tab control to some extent. However, a tab detection sensor having multiple devices is required to accurately detect tab positions and tab types. Therefore, a complicated mechanism is required sp as to arrange a tab detection sensor having multiple devices, and it is also necessary to provide a detection circuit with multiple input ports to receive detection results by the tab detection sensor having multiple devices.

In recent years, with various image forming apparatuses, such as copiers and printers, it has been attempted to perform image forming by the use of "unprocessed tabbed transfer sheet blanks" which can be processed into tabbed transfer sheets having a tab (tabbed transfer sheets) by post-processing. Hereinafter, an unprocessed tabbed transfer sheet blank means a transfer sheet that can be processed into a tabbed transfer sheet having a tab by post-processing.

FIGS. 7*a* and 7*b* illustrate the state of unprocessed tabbed transfer sheet blanks. Herein, FIG. 7*a* shows the state of an unprocessed tabbed transfer sheet blank before post-processing. Herein, the transfer sheet is in a rectangular shape in a larger size than a regular size such as to contain the area to be processed into a tab and the peripheral area.

FIG. 7*b* shows the state that an unprocessed tabbed transfer sheet blank has become a tabbed transfer sheet after post-processing. Herein, the area that was prepared for processing into a tab remains as a tab, while the unnecessary peripheral area has been trimmed by a post-processing device. As a result, now in the state after post-processing, the transfer sheet is the same as a regular tabbed transfer sheet in the shape and size.

Such unprocessed tabbed transfer sheet blanks are not formed with an actual tab at the time of sheet feeding and image forming on an image forming apparatus. Accordingly, there is a problem that conventional tab detection is not practical at all in this regard.

The present invention has been devised to overcome problems, such as described above, and an object of the invention is to realize an image forming apparatus capable of reliably detecting tab positions and tab types and image forming in a state that tab sheets are inserted correctly, with a simple control, regardless of tabbed transfer sheets or unprocessed tabbed transfer sheet blanks.

SUMMARY OF THE INVENTION

To solve problems, as described above, in an aspect of the present invention, there is provided an image forming apparatus for use with a transfer sheet, including:

a sheet feeding unit structured to feed the transfer sheet;

a color detection sensor structured to detect color information on the transfer sheet fed from the sheet feeding unit;

a recognition section structured to recognize whether the transfer sheet subjected to the detection by the color detection sensor is a non-tabbed transfer sheet having no tab, or either a tabbed transfer sheet having a tab or an unprocessed tabbed transfer sheet blank, the unprocessed tabbed transfer sheet blank being capable of being processed into a tabbed transfer sheet having a tab by post-processing, wherein a recognition result is made based on the color information detected by the color detection sensor; and a control section that controls image forming on and conveying of the fed transfer sheet, according to the recognition result by the recognition section.

BRIEF DESCRIPTION OF THE DRAWINGS

FIGS. 7*a* and 7*b* are illustrations showing a state of an unprocessed tabbed transfer sheet blank used in the image forming apparatus;

DESCRIPTION OF THE PREFERRED EMBODIMENT OF THE INVENTION

Figure 1:
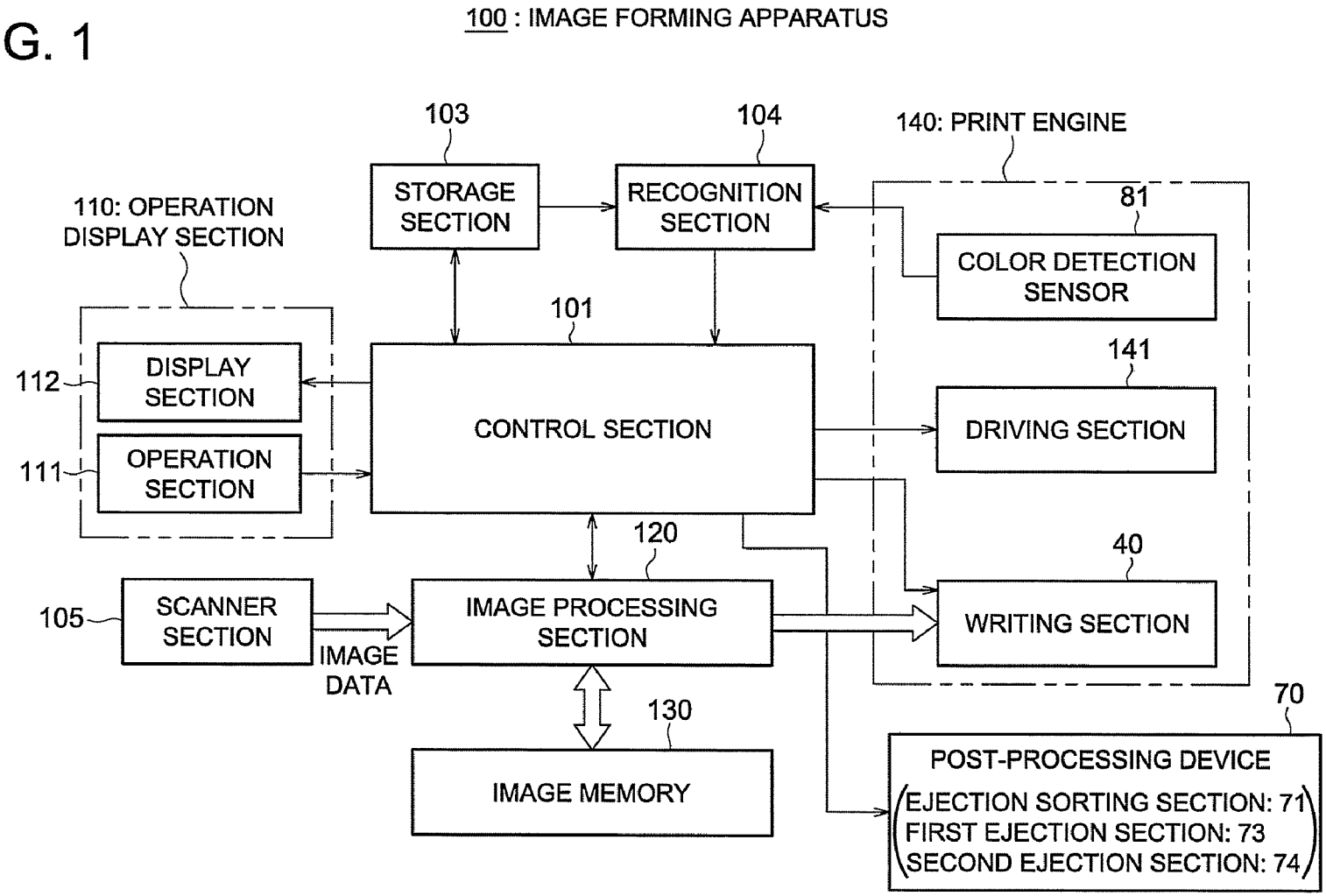
FIG. 1 is a function block diagram showing the electrical structure of an image forming apparatus in an embodiment of the present invention.

A preferred embodiment of the present invention will be described below, referring to the drawings.

The invention can be applied, for example, to an image recording apparatus (copier) provided with a function to read the contents of objects for copying with a document reading section (scanner), and also applied to an image forming apparatus having no document reading section (scanner). Further, the invention can be applied to an image forming apparatus, such as a multi-functional machine provided with a facsimile function.

First, the mechanical structure of an entire image forming apparatus in an embodiment will be described, referring to FIG. 2.

(Mechanical Structure and Overall Operation of an Image Forming Apparatus)

First, the mechanical structure of the image forming apparatus will be described, referring to FIG. 2. Herein, a copier that reads images on documents and forms images will be taken as an example in the present embodiment, and the example of the copier herein is an image forming apparatus as a copier of an electrophotographic type.

Figure 2:
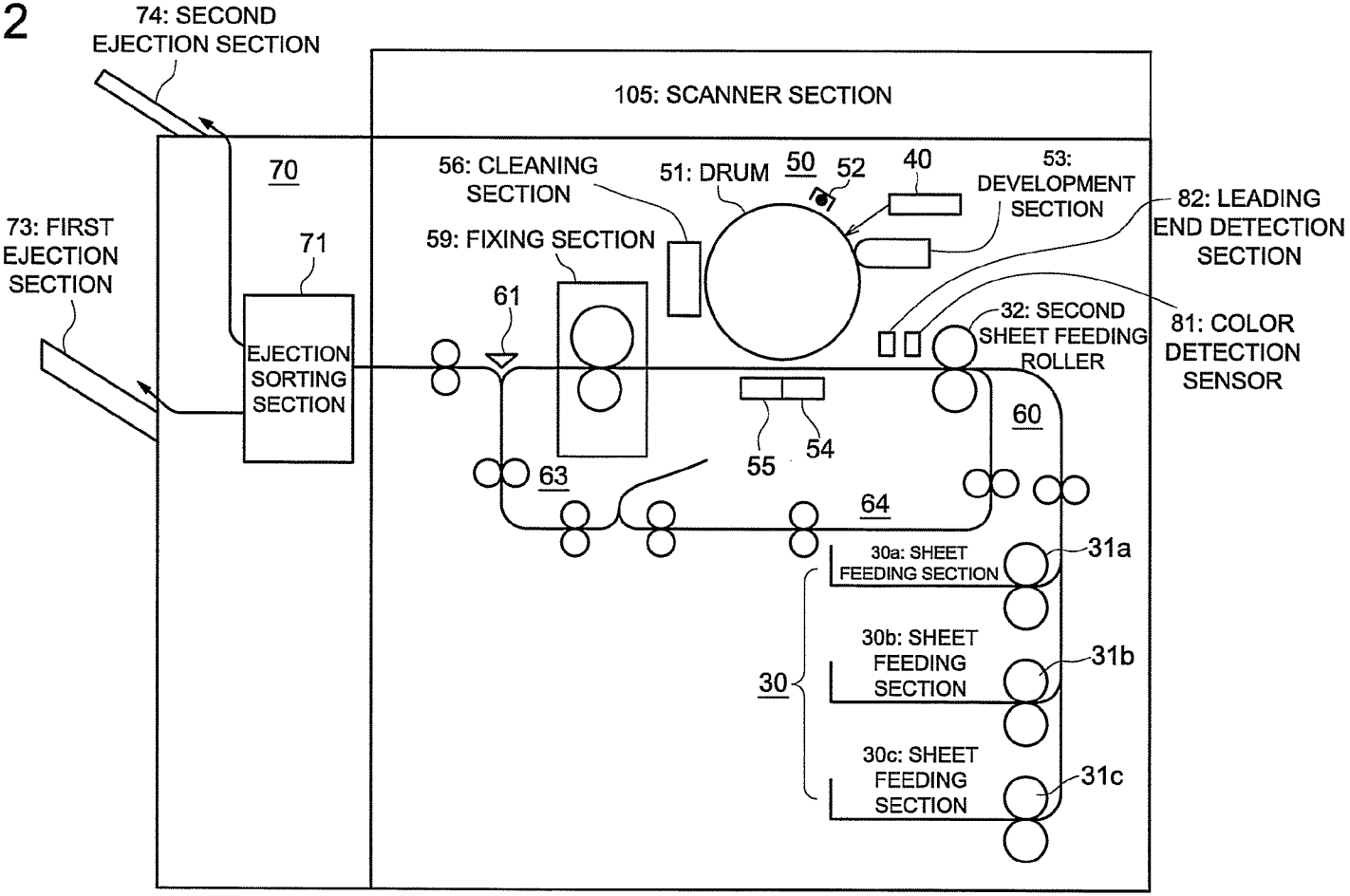
FIG. 2 is a structure diagram showing the mechanical structure of the image forming apparatus in the embodiment of the present invention.

Further, the example shown in FIG. 2 is in a state that a post-processing device is connected to the image forming apparatus main body, wherein the post-processing device is considered also to be a part of the image forming apparatus.

In FIG. 2, a sheet feeding unit 30 feeds transfer sheets having been accumulated, and is provided, herein, with three sheet feeding sections 30*a*, 30*b* and 30*c*. An image writing section 40 generates light beams for exposure, corresponding to image data, and is provided with a solid-scanning photomodulation device, a laser beam exposure device, and the like. Image forming section 50 performs recording an image on a recording medium P (generally called a recording sheet or a transfer sheet, and referred to as a transfer sheet in the present specification) by an electrostatic method, and is provided with a drum 51, charging section 52, development section 53, transfer section 54, separation section 55, cleaning section 56, fixing section 59 and the like. A conveyance driving section 60 conveys transfer sheets, and is provided with a reverse-rotation conveying section 63, circulation conveying section 64 for double sided image forming, and the like.

A post-processing device 70 performs various post-processing for finishing of transfer sheets on which the image recording apparatus has formed images. For example, the post-processing device 70 performs sorting by an ejection sorting section 71 at the time of ejection to plural ejection sections, namely a first ejection section 73 and second ejection section 74, and performs other various post-processing, as necessary, such as stapling processing and punching processing, not shown.

Further, tab processing on unprocessed tabbed transfer sheet blanks to form tabbed transfer sheets is performed by a post-processing device, not shown.

A color detection sensor 81 detects color information on transfer sheets fed from the sheet feeding unit 30. The color detection sensor 81 preferably performs detection prior to image forming, and is disposed adjacent to a second sheet feeding roller.

In such case, the color detection sensor 81 is only required to perform detection prior to image forming, and may be arranged to perform detection of the colors of transfer sheets at any position, during the time when the transfer sheets are stopping in the sheet feeding unit 30, or during the time when the transfer sheets are moving, or just after the transfer sheets are fed from the sheet feeding unit 30. Further, it is possible to use the color detection sensor 81 that serves also as another sensor, such as a leading end detection sensor 82.

Herein, upon instruction for image forming from a control section, described later, a transfer sheet p is taken out by one of first feeding rollers 31*a* to 31*c* from one of sheet feeding sections 30*a* to 30*c* on which the transfer sheet p is loaded, and fed toward the image forming section 50.

In the present embodiment, plural sheet feeding sections are provided to stack transfer sheets so as to enable an inter-sheet function to feed sheets from different sheet feeding sections. These sheet feeding sections 30*a* to 30*c* and the first sheet feeding rollers 31*a* to 31*c* structure the sheet feeding unit that feeds transfer sheets p. Herein, although a case of three stairs is taken as an example of a multiple sheet feeding unit, the invention is not limited thereto.

By a second sheet feeding roller (registration roller) 32 adjacent to the entrance of the image forming section 50, a transfer sheet p to be fed to the image forming section 50 is synchronized with forming of a toner image at the drum 51 such that the transfer sheet interval length is constant (Ti), and then the transfer sheet p approaches the drum 51 which is an image carrier.

During this, the color detection sensor 81 detects the color of the transfer sheet p, and the detected color information is transmitted to a recognition section, described later. Thereafter, the leading end of the transfer sheet p is detected by the leading end detection sensor 82, and according to the detection result, projection timing of laser beams, described later, onto the drum 51 is determined.

Image data is input to the image writing section 40 from a recording image processing section, and according to the detected result of the transfer sheet p at the leading end detection sensor 82, the drum 51 is irradiated with laser beams from a laser diode in the image writing section 40, corresponding to the image data, so that an electrostatic latent image is formed on the drum 51. This electrostatic latent image is developed by a development section 53 so that a toner image is formed on the drum 51.

A transfer section 54 below the drum 51 transfers this toner image to the transfer sheet p. Then, the transfer sheet p in press-contact with the drum 51 is separated by a separation section 55. The transfer sheet p separated from the drum 51 enters the fixing section 59 through a conveying mechanism, and the toner image gets fixed with heat and pressure. Thus, an image is formed on the transfer sheet p.

As necessary, the transfer sheet p with a fixed toner image is conveyed downward through a guide 61 to enter the reverse-rotation conveying section 63. Then, the transfer sheet p present in the reverse-rotation section 63 is taken out again by a reverse-rotation roller, not shown, to be conveyed again to the image forming section 50 through a circulation conveying section 64 for double-side image forming. In the image forming section 50 having performed image forming on one side, toner adhered to the drum 51 is removed by a cleaning section 56, and the drum 51 is charged by a subsequent charging section 52 to be prepared for the next image forming.

In this state, the other side of the transfer sheet p (the side on which image forming has not yet been performed) is conveyed into the image forming section 50, and an image is formed on it. The transfer sheet p separated from the drum 51 by the separation section 55 again enters the fixing section 59 for fixing.

Accordingly, the conveyance driving section 60 includes various conveying rollers and a conveying belt that convey transfer sheets after the second conveying roller 32, and a certain control is performed on conveyance at the conveyance driving section 60 in the present embodiment.

The transfer sheet p on which both sides image forming has been completed thus, or the transfer sheet p on which one side image forming has been completed thus is conveyed to the post-processing device 70. The post-processing device 70 is provided with an ejection sorting section 71, first ejection section 73, and second ejection section 74, and transfer sheets are sorted by the ejection sorting section 71 to either ejection section to be ejected.

In the present embodiment, transfer sheets are fed from the sheet feeding unit 30 capable of feeding transfer sheets without a tab (in the present embodiment, referred to as "a non-tabbed transfer sheets/sheets"), transfer sheets with a tab (hereinafter in the present embodiment, referred to as "a tabbed transfer sheet/sheets") and transfer sheets ready for processing into transfer sheets having a tab by post-processing (in other words, transfer sheets being capable of being processed into tabbed transfer sheets having a tab by post processing, and in the present embodiment, referred to as "an unprocessed tabbed transfer sheet blank/blanks"). The color detection sensor 81 performs detection on a fed transfer sheet (a non-tabbed transfer sheet, tabbed transfer sheet, or unprocessed tabbed transfer sheet blank) prior to image forming, and control of image forming and conveying is performed, corresponding to the transfer sheet.

As a result, by using transfer sheets in respective colors detectable by the color detection sensor, as tabbed transfer sheets or unprocessed tabbed transfer sheet blanks, it is possible to perform suitable control of image forming on and conveying of the tabbed transfer sheets or unprocessed tabbed transfer sheet blanks in a state that correct recognition is made on the tabbed transfer sheets or unprocessed tabbed transfer sheet blanks.

Herein, the control of suitable conveying of tabbed transfer sheets or unprocessed tabbed transfer sheet blanks is control of conveyance in a state where a suitable sheet conveying interval length of a transfer sheet from another transfer sheet is maintained, wherein the former described transfer sheet is in a size different than a regular size and has a tab area or an unprocessed tab area (Hereinafter, also referred to merely as an unprocessed tab) that can be processed into a tab by post-processing.

Further, the suitable image forming on tabbed transfer sheets or unprocessed tabbed transfer sheet blanks is image forming in a suitable state on a tab area, an area to become a tab by post-processing, or an area other than a tab area.

In the post-processing device 70, necessary ejection sorting is performed, according to the detection result by the detection sensor 81, and corresponding to the tab state of the transfer sheet.

(Electrical Structure of the Image Forming Apparatus)

FIG. 1 is a function block diagram showing the detailed electrical structure in the image forming apparatus in the present embodiment.

The image forming apparatus 100, which can be various types, performs image forming on various types of transfer sheets including tabbed transfer sheets and unprocessed tabbed transfer sheet blanks and provides outputs.

The image forming apparatus 100 includes a control section 101 that performs overall control of the image forming apparatus and control on tabbed transfer sheets or unprocessed tabbed transfer sheet blanks, storage section 103 that stores inputted pieces of color information and pieces of tab information and correspondence relationships therebetween, recognition section 104 that refers to the correspondence relationships between the pieces of color information and the pieces of tab information stored in the storage section 103 and thereby recognizes tab information corresponding to the color information detected by the color detection sensor 81, scanner section 105 that reads images, operation display section 110 for various operations and input of various information and for display of the status of the image forming apparatus, image processing section 120 that performs, in addition to ordinary image processing, image processing on tabbed transfer sheets and unprocessed tabbed transfer sheet blanks, image memory 130 to load or hold image data and various data in image forming at the image processing section 120, and print engine 140 that forms images on transfer sheets.

Further, as necessary, it is possible to provide the image forming apparatus with the post-processing device 70 that performs post-processing for finishing transfer sheets on which an image/images have been formed. This post-processing device 70 is provided with the ejection sorting section 71 that sorts transfer sheets to plural ejection sections (the first ejection section 73 and second ejection section 74 in the present embodiment). The control section 101 performs control of image forming in the present embodiment.

Further, the post-processing device, not shown, performs tab processing as post-processing that processes unprocessed tabbed transfer sheet blanks into tabbed transfer sheets by trimming the peripheral area of an unprocessed tab area. Herein, an unprocessed tab area is an area being capable of being processed into a tab by post-processing.

Still further, the operation display section 110 contains the operation section 111 as an information input section through which to input color information and tab information on tabbed transfer sheets and/or on unprocessed tabbed transfer sheet blanks accompanied with the correspondence relationships between the pieces of color information and the pieces of tab information, and a display section 112 that displays various information and various status.

Herein, the relationships between the pieces of color information and pieces of tab information on tabbed transfer sheets and/or unprocessed tabbed transfer sheet blanks, are stored in the storage section 103. Herein, tab information includes various kinds of tab information, such as tab patterns, tab positions (tab positions with respect to conveying direction and tab positions with respect to direction perpendicular to conveying direction), tab widths, tab lengths, tab division numbers, insertion pages, presence of images on either or both sides of tabs and the contents of images on either or both sides of tabs.

Hereinafter, a category of tabbed transfer sheets or unprocessed tabbed transfer sheet blanks having the same shape, size and the like including whether they are tabbed transfer sheets or unprocessed tabbed transfer sheet blanks, will be referred to as a 'type' of transfer sheet. Herein, a type corresponds to a piece of tab information (that is, a tab information set including a shape, size and the like). Tabbed transfer sheets or unprocessed tabbed transfer sheet blanks are given different colors, depending on the respective pieces of tab information, namely respective types.

When controlling conveyance of tab transfer sheets, described later, in order to control conveyance of a transfer sheet, in a size different than a regular size, having a tab area or of an unprocessed tab area, such as to maintain a suitable sheet conveying interval length from another transfer sheet, information on the tab direction (whether a tab is at the leading end or trailing end with respect to the conveying direction, or whether the tab is present on a side perpendicular to the conveying direction) is also contained in the pieces of tab information having relationships with the pieces of color information on tabbed transfer sheets and/or unprocessed tabbed transfer sheet blanks.

Further, a speaker, buzzer, alarm lamp or the like constructs an alarm section that makes an alarm with output of an alarm indication, alarm sound, alarm message audio, or combination of them.

The print engine 140 includes the writing section 40 (shown in FIG. 2) that performs writing based on image data processed by the image processing section 120, the color detection sensor 81 (shown in FIG. 2) that detects the color of a transfer sheet serving as a tab detection section, the leading end detection sensor 82 (shown in FIG. 2) that detects the leading end of a transfer sheet during conveyance so as to synchronize the conveyance timing and image forming timing of the transfer sheet, and driving section 141 for sheet feeding and conveyance of various sheets. Herein, a trailing end detection sensor that detects the trailing end of a transfer sheet may be arranged instead of the leading end detection sensor 82.

The color detection sensor 81 detects the color of a fed transfer sheet prior to image forming on the transfer sheet, and the recognition section 104 recognizes whether the transfer sheet is a non-tabbed transfer sheet, or either a tabbed transfer sheet or unprocessed tabbed transfer sheet blank, based on the detected color of the transfer sheet.

The control section 101 of the image forming apparatus 100 performs control of image forming on and conveying of a tabbed transfer sheet or unprocessed tabbed transfer sheet blank, taking into account the tab area or the unprocessed tab area to be processed into a tab by post-processing, based on a recognition result by the recognition section 104.

The image forming apparatus 100 can be one of various types including a copier, facsimile device, and printer. The print engine 140 may be an electrophotograhic type using laser beam, a type using a LED print head, an inkjet type, a thermal type, or a sublimation type.

Description of Operation in the Present Embodiment

Operation of the above image forming apparatus will be described, referring to FIG. 3. Herein, the subroutine shown by the flowchart in FIG. 3 is called by an image forming control program that operates in the control section 101.

In the following discussion of the operation in the present embodiment, control and operation by the control section 101 and subroutines of the image forming control program (computer program) will be described, being referred to merely as control by the control section 101.

First, it is assumed that a user has selected usage of either tabbed transfer sheets or unprocessed tabbed transfer sheet blanks via the operation section 111. Herein, normally, tabbed transfer sheets or unprocessed tabbed transfer sheet blanks are used as inter-sheets. That is, it is assumed that "application function" is selected via the operation section 111, and further, "inter-sheet" is selected, and then "tabbed transfer sheets" or "unprocessed tabbed transfer sheet blanks" are selected as inter-sheets.

Figure 3:
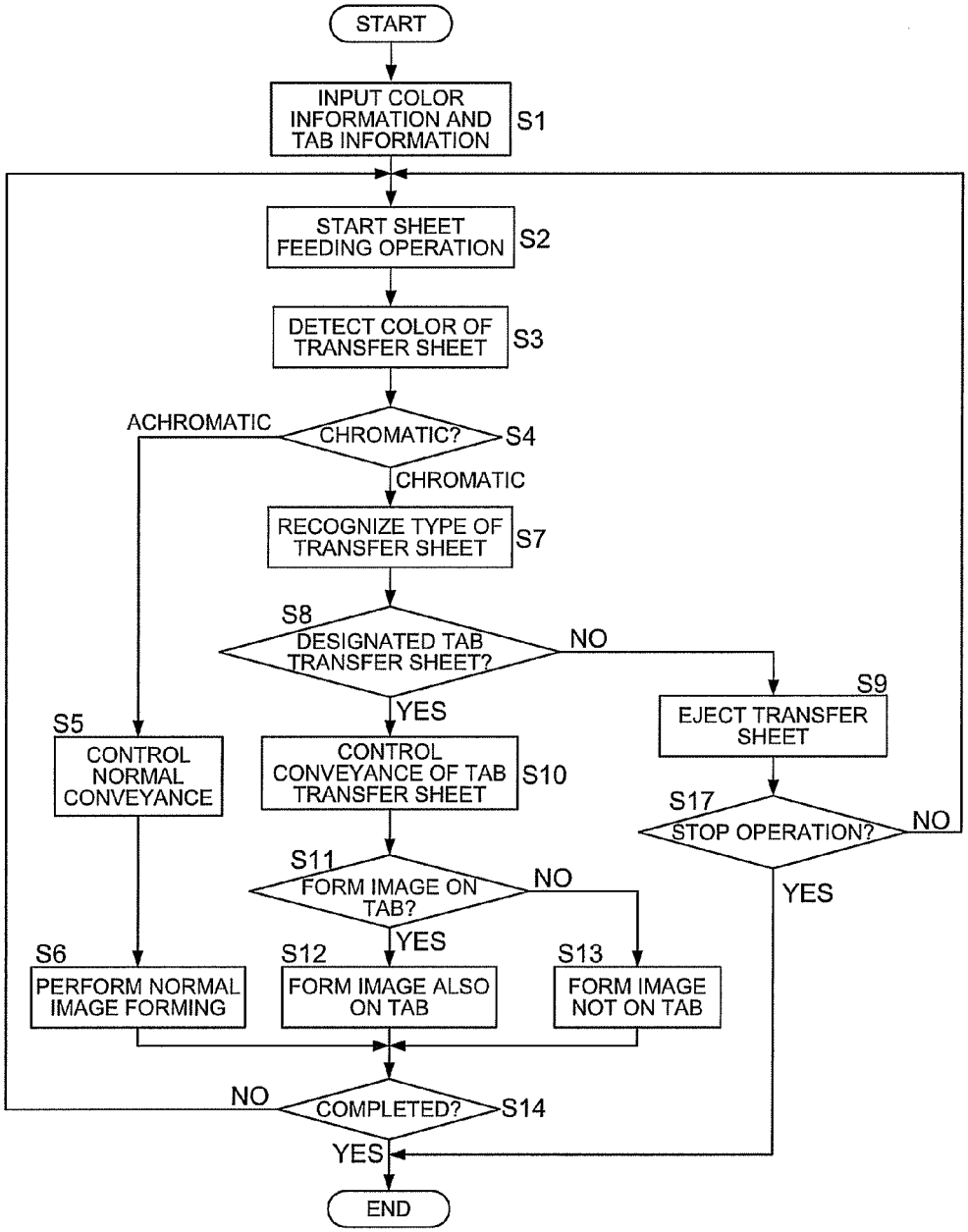
FIG. 3 is a flowchart showing the operation procedure of the image forming apparatus in the embodiment of the present invention.
Figure 4:
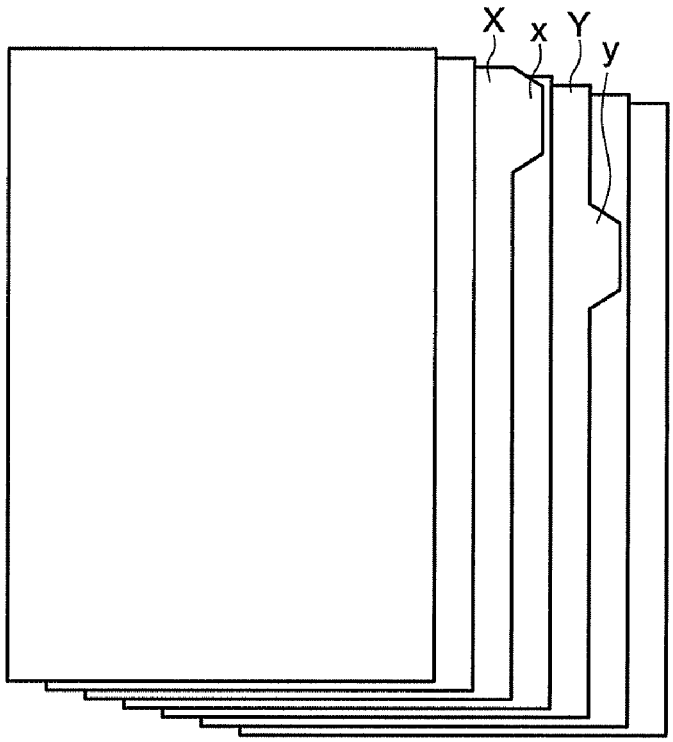
FIG. 4 is an illustration showing a state of tabbed transfer sheets used in the image forming apparatus.
Figure 5:
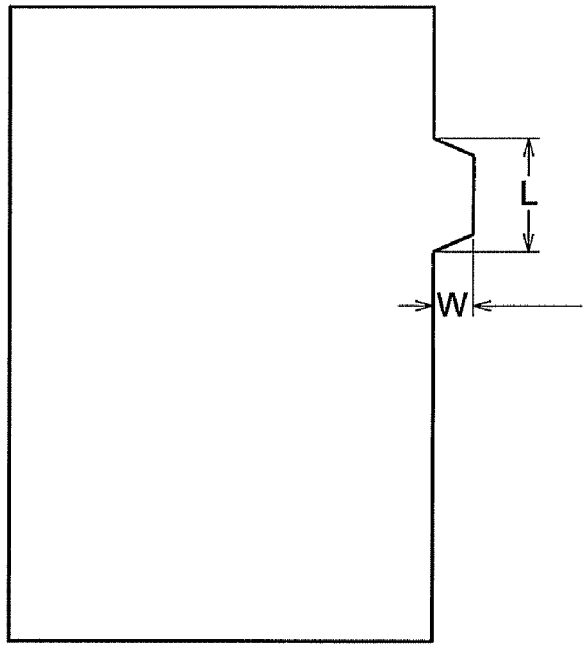
FIG. 5 is an illustration showing a state of a tabbed transfer sheet used in the image forming apparatus.
Figure 6:
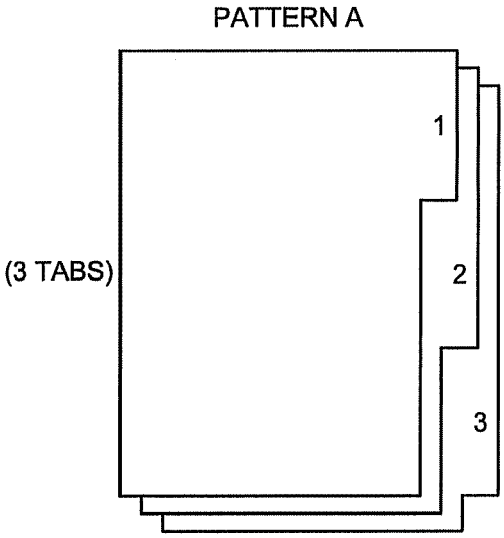
FIGS. 6*a* to 6*d* are illustrations showing a state of tabbed transfer sheets used in the image forming apparatus.
Figure 6:
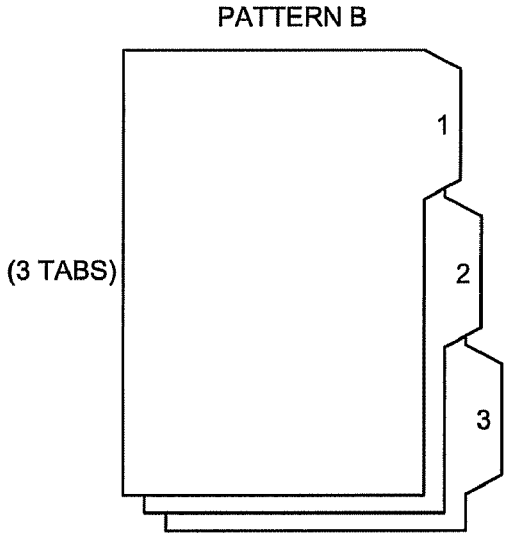
Figure 6:
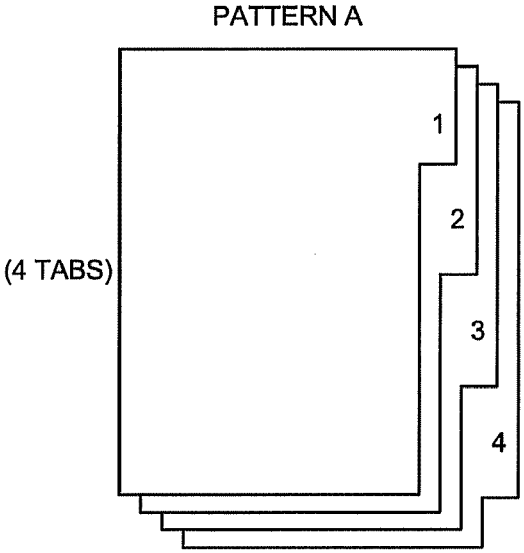
Figure 6:
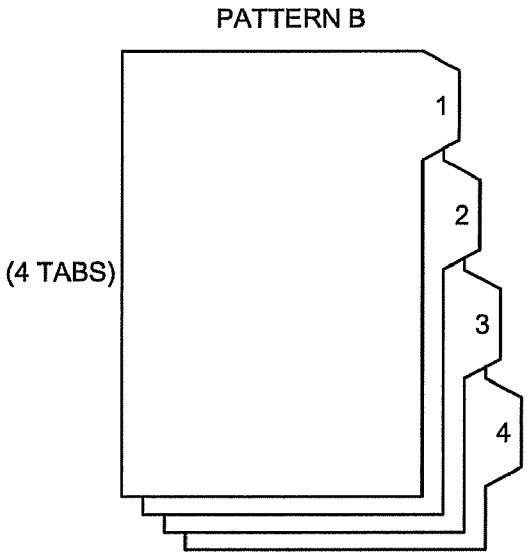

Herein, the control section 101 displays a screen for input of various information about tabbed transfer sheets or unprocessed tabbed transfer sheet blanks on the display section 112, and receives input of "tab information" and "color information" from the user (step S1 in FIG. 3). Further, in case of performing image forming on a tab, input of "tab-image-forming information" is received in addition to "tab information" and "color information" (step S1 in FIG. 3).

The color information, tab information and tab-image-forming information may be transmitted from an external device, such as a computer, via a network or memory card. Further, they may not be input at the time of copying operation, but may be input or transmitted in advance.

Herein, color information is information on the colors of transfer sheets used as tabbed transfer sheets or unprocessed tabbed transfer sheet blanks. Tab information is information on tabs or unprocessed tab areas described above. Tab-image-forming information is information on characters and/or images to be formed in the tab areas of tabbed transfer sheets or the unprocessed tab areas of unprocessed tabbed transfer sheet blanks.

The control section 101 controls the storage section 103 to store pieces of color information, pieces of tab information and pieces of tab-image-forming information accompanied with correspondence relationships therebetween.

Tab-image-forming information is necessary in a case of forming an image in a tab area, and is not essential. Further, tab-image-forming information may be received together with normal image data or separately from normal image data, as electronic data from an external device.

When input of the above described color information and tab information is completed, the control section 101 is standby in a state waiting for a copy start. When a copy start key of the operation section 111 is pressed down in this state, the control section 101 starts image forming based on supplied image data or an image read by the scanner section 105, under conditions being set.

Herein, the control section 101 feeds transfer sheets from the sheet feeding sections 30*a* to 30*c* (step S2 in FIG. 1). At a timing of a page position to form an image on a non-tabbed transfer sheet, the control section 101 feeds a sheet from a sheet feeding section on which non-tabbed transfer sheets are stacked. At a timing of a page position to form an image on a tabbed transfer sheet or unprocessed tabbed transfer sheet blank, the control section 101 feeds a sheet from a sheet feeding section on which tabbed transfer sheets or unprocessed tabbed transfer sheet blanks are stacked.

Herein, the color detection sensor 81 detects the color of a transfer sheet having been fed and conveyed (step S3 in FIG. 3). Color information obtained by the detection is transmitted to the recognition section 104.

In the present embodiment, an example will be discussed in which an achromatic color, such as white, is designated for non-tabbed transfer sheets, and each one chromatic color is designated for a respective type of a tabbed transfer sheet or unprocessed tabbed transfer sheet blank. However, it is also possible to set a chromatic color for non-tabbed transfer sheets and achromatic colors for tabbed transfer sheets and unprocessed tabbed transfer sheet blanks.

When color information from the color detection sensor 81 is an achromatic color, such as white ("achromatic" in step S4 in FIG. 3), the recognition section 104 recognizes that the transfer sheet is not a tabbed transfer sheet nor an unprocessed tabbed transfer sheet blank, and the control section 101 performs normal conveyance control based on the recognition result (step S5 in FIG. 3).

Herein, normal conveyance control is a conveyance control that controls driving of the second sheet feeding roller 32 so that the leading end position of a non-tabbed transfer sheet with respect to the conveyance direction and the leading end position of the next non-tab transfer sheet with respect to the conveyance direction are maintained at a normal interval length.

On a transfer sheet recognized as a non-tabbed transfer sheet by the recognition section 104 and subjected to the normal conveyance control by the control section 101 (step S5 in FIG. 3), normal image forming is performed (step S6 in FIG. 3) by the control section 101, based on the recognition, and the non-tabbed transfer sheet is ejected to a designated ejection section.

On the other hand, if color information from the color detection sensor 81 is a chromatic color ("chromatic" in step S4 in FIG. 3) in the present embodiment, the recognition section 104 recognizes that the transfer sheet is a tabbed transfer sheet or unprocessed tabbed transfer sheet blanks, and retrieves tab information corresponding to the color information from the stored contents of the storage section 103 so as to recognize the type of the transfer sheet, in other words, which tab the transfer sheet has (step S7 in FIG. 3).

Then, the control section 101 determines whether or not the detected transfer sheet is either a tabbed transfer sheet or an unprocessed tabbed transfer sheet blank that is designated by the tab information and has a tab or an unprocessed tab area to be inserted at this timing. Herein, the determination is made based on whether there is an accordance between the tab information recognized in step S7 and the tab information that has been input as the tab information of a type of a transfer sheet to be inserted at this timing (step S8 in FIG. 3). In the flowchart shown in FIG. 3, the description "tab transfer sheet" represents "tabbed transfer sheet and unprocessed tabbed transfer sheet blank".

Herein, if the recognized transfer sheet is not a tabbed transfer sheet nor unprocessed tabbed transfer sheet blank that has a tab or unprocessed tab area to be inserted at this timing and is designated by the tab information ("No" in step S8 in FIG. 3), the control section 101 instructs the ejection sorting section 71 to eject the transfer sheet to the ejection section which is not on the side of the ejection section used for current ejection (step S9 in FIG. 3).

Herein, in a case where, according to setting information having been input or set in association with tab information, the operation is set such as to stop image forming operation when a transfer sheet having a wrong tab or wrong unprocessed tab area is fed, the control section 101 stops image forming operation ("Y" in step S17 in FIG. 3). In this case, as necessary, the control section 101 displays the event that image forming has stopped and displays the reason for the stoppage, on the display section 112. Further, as necessary, the control section 101 performs output of a sound by a buzzer, not shown, or a message voice, or output of a combination of these.

In a case where the operation is set such as not to stop image forming operation even when a transfer sheet having a wrong tab is fed, the control section 101 returns to sheet feeding operation (step S2 in FIG. 3), and resumes operation from sheet feeding operation, according to setting information.

Herein, if the control section 101 has determined that the detected transfer sheet is either a tabbed transfer sheet or unprocessed tabbed transfer sheet blank that has a tab or an unprocessed tab area to be inserted at this timing, and is designated by the tab information ("Y" in step S8 in FIG. 3), the control section 101 performs conveyance control to be performed on the tabbed transfer sheet or unprocessed tabbed transfer sheet blank (step S10 in FIG. 3).

Figure 8:
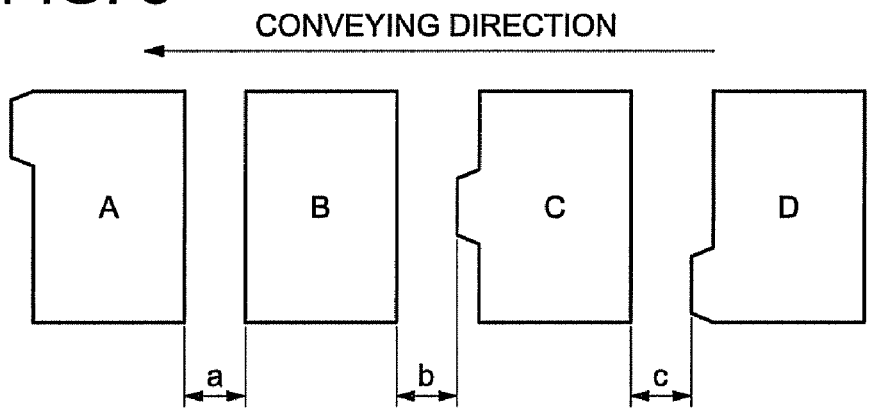
FIG. 8 is an illustration showing a state of tabbed transfer sheets used in the image forming apparatus.

Herein, in a case, as shown in FIG. 8, where the tab is present at the leading end of a transfer sheet with respect to the conveyance direction, a conveyance control of tabbed transfer sheets is performed such that the interval length ("b" in FIG. 8) between the trailing end of a transfer sheet (B in FIG. 8) ahead of a tabbed transfer sheet (C in FIG. 8) and the leading end of the tab of the tabbed transfer sheet (C in FIG. 8) is equal to the sheet conveyance interval length not associated with a tab ("a" in FIG. 8). Likewise, this conveyance control is performed such that the distance ("c" in FIG. 8) between the trailing end of a transfer sheet (C in FIG. 8) ahead of a tabbed transfer sheet (D in FIG. 8) and the leading end of the tab of the tabbed transfer sheet (D in FIG. 8) is equal to the sheet conveyance interval length not associated with a tab ("a" in FIG. 8). Such a conveyance control is "a suitable conveyance control of tabbed transfer sheets".

Figure 9:
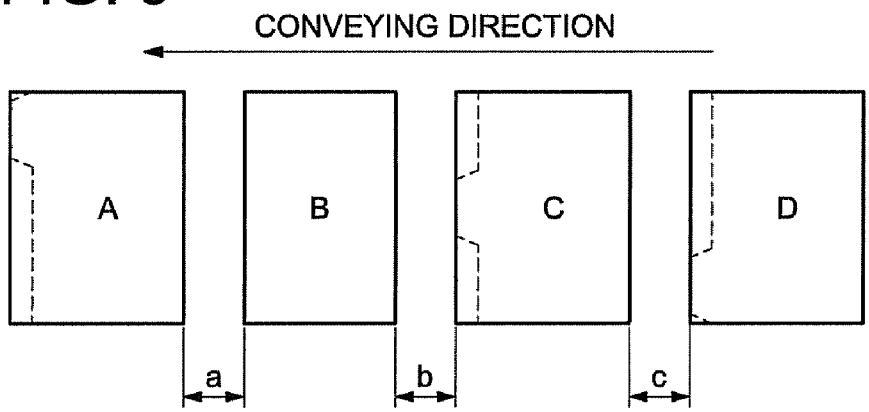
FIG. 9 is an illustration showing a state of unprocessed tabbed transfer sheet blanks used in the image forming apparatus.

In a case, as shown in FIG. 9, where an unprocessed tab area is present at the leading end of a transfer sheet with respect to the conveyance direction, a conveyance control of unprocessed tabbed transfer sheet blanks is performed such that the interval length ("b" in FIG. 9) between the trailing end of a transfer sheet (B in FIG. 9) ahead of a unprocessed tabbed transfer sheet blank (C in FIG. 9) and the leading end of the unprocessed tab area of the unprocessed tabbed transfer sheet blank (C in FIG. 9) is equal to the sheet conveyance interval length not associated with a tab ("a" in FIG. 9). Likewise, this conveyance control is performed such that the distance ("c" in FIG. 9) between the trailing end of a transfer sheet (C in FIG. 9) ahead of a unprocessed tabbed transfer sheet blank (D in FIG. 9) and the leading end of the unprocessed tab area of the unprocessed tabbed transfer sheet blank (D in FIG. 9) is equal to the sheet conveyance interval length not associated with a tab ("a" in FIG. 9). Such a conveyance control is "a suitable conveyance control of unprocessed tabbed transfer sheet blanks".

Figure 10:
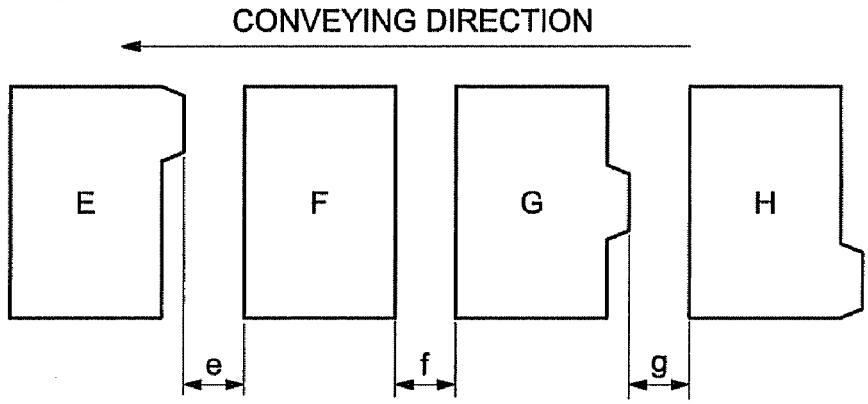
FIG. 10 is an illustration showing a state of tabbed transfer sheets used in the image forming apparatus.

Further, in a case, as shown in FIG. 10, where the tab is present at the trailing end of a transfer sheet with respect to the conveyance direction, a conveyance control of tabbed transfer sheets is performed such that the interval length ("e" in FIG. 10) between the trailing end of a tabbed transfer sheet (E in FIG. 10) and the leading end of a transfer sheet (F in FIG. 10) following the tabbed transfer sheet (E in FIG. 10) is equal to the sheet conveyance interval length not associated with a tab ("f" in FIG. 10). Likewise, this conveyance control is performed such that the distance ("g" in FIG. 10) between the trailing end of a tabbed transfer sheet (G in FIG. 10) and the leading end of a transfer sheet (H in FIG. 10) following the tabbed transfer sheet (G in FIG. 10) is equal to the sheet conveyance interval length not associated with a tab ("f" in FIG. 10). Such a conveyance control is "a suitable conveyance control of tabbed transfer sheets".

Figure 11:
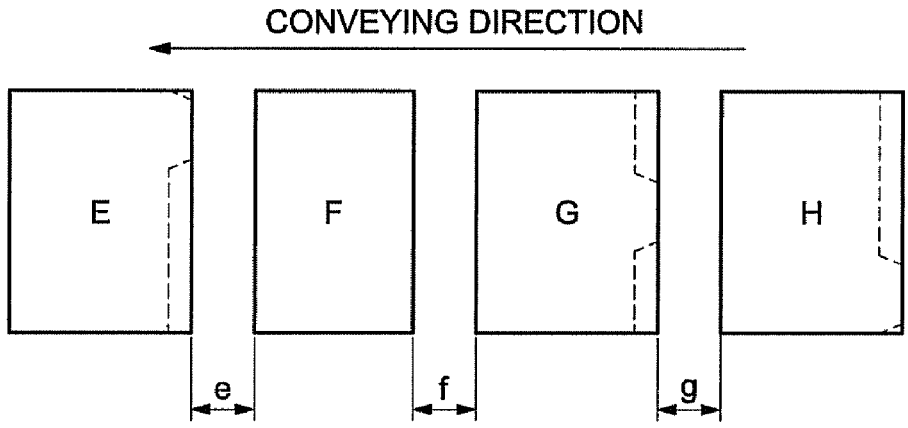
FIG. 11 is an illustration showing a state of unprocessed tabbed transfer sheet blanks used in the image forming apparatus.

Still further, in a case, as shown in FIG. 11, where the tab or unprocessed tab area is present at the trailing end of a transfer sheet with respect to the conveyance direction, a conveyance control of unprocessed tabbed transfer sheet blanks is performed such that the interval length ("e" in FIG. 11) between the trailing end of an unprocessed tabbed transfer sheet blank (E in FIG. 11) and the leading end of a transfer sheet (F in FIG. 11) following the unprocessed tabbed transfer sheet blank (E in FIG. 11) is equal to the sheet conveyance interval length not associated with a tab ("f" in FIG. 11). Likewise, this conveyance control is performed such that the distance ("g" in FIG. 11) between the trailing end of a unprocessed tabbed transfer sheet blank (G in FIG. 11) and the leading end of a transfer sheet (H in FIG. 11) following the unprocessed tabbed transfer sheet blank (G in FIG. 11) is equal to the sheet conveyance interval length not associated with a tab ("f" in FIG. 11). Such a conveyance control is "a suitable conveyance control of unprocessed tabbed transfer sheet blanks".

Figure 12:
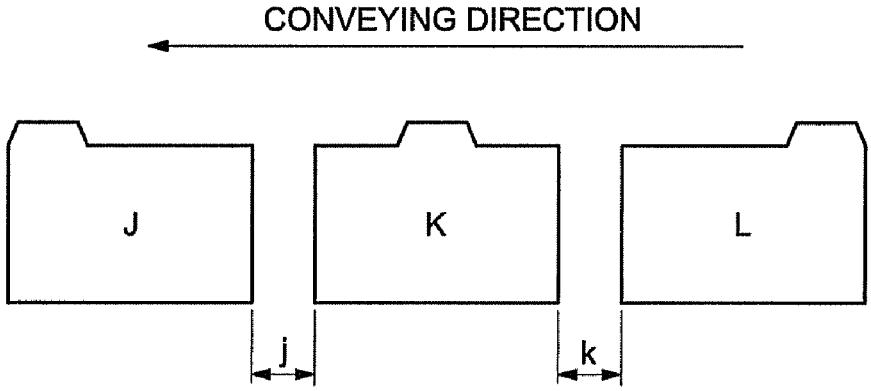
FIG. 12 is illustrations showing a state of tabbed transfer sheets used in the image forming apparatus.
Figure 13:
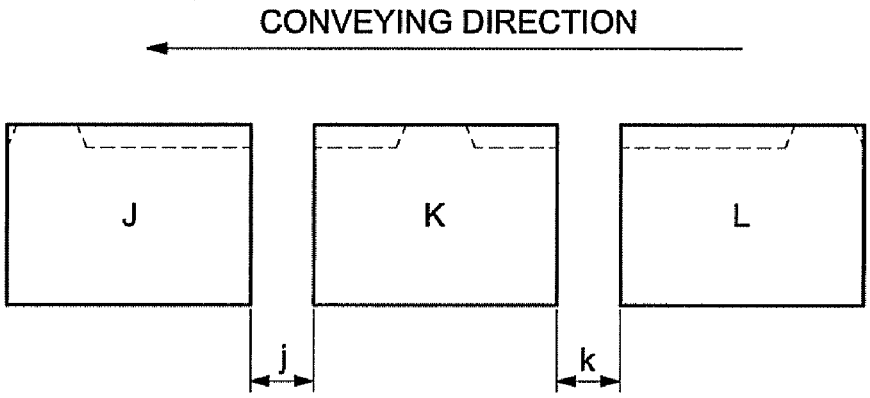
FIG. 13 is an illustration showing a state of unprocessed tabbed transfer sheet blanks used in the image forming apparatus.

In a case, as shown in FIG. 12, where the tabs of tabbed transfer sheets are present on a side perpendicular to the conveyance direction (a side along the transfer sheet conveyance direction), the tabs do not effect the sheet conveyance interval length, and accordingly, conveyance control of tabbed transfer sheets can be performed the same as the conveyance control of regular transfer sheets without a tab. Further, in a case, as shown in FIG. 13, where the unprocessed tab areas of unprocessed tabbed transfer sheet blanks are present on a side perpendicular to the conveyance direction (a side along the transfer sheet conveyance direction), the tabs do not effect the sheet conveyance interval, and accordingly, conveyance control of unprocessed tabbed transfer sheet blanks can be performed the same as the conveyance control of regular transfer sheets without a tab.

Herein, the control section 101 checks if a character/characters or image is to be formed in the tab area of a tabbed transfer sheet or the unprocessed tab area of an unprocessed tabbed transfer sheet blank, according to tab-image-forming information having been set and stored in the storage section 103 (step S11 in FIG. 3).

If setting is made such as to perform image forming in the tab area or unprocessed tab area (Y in step S11 in FIG. 3), the control section 101 controls respective sections so as to form an image on a transfer sheet, including the tab area (step S12 in FIG. 3).

If setting is made such as not to perform image forming in the tab area or unprocessed tab area (N in step S11 in FIG. 3), the control section 101 controls to form an image on a transfer sheet, excluding the tab area or unprocessed tab area (step S13 in FIG. 3).

Figure 14:
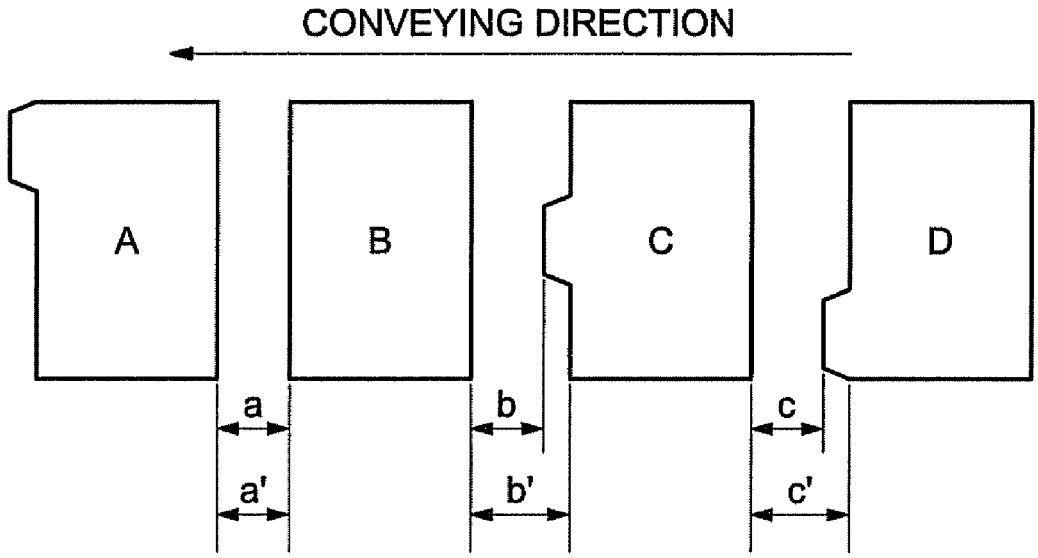
FIG. 14 is an illustration showing a state of tabbed transfer sheets used in the image forming apparatus.

Herein, although the sheet conveyance interval length between the trailing end of the transfer sheet B and the leading end of the tabbed transfer sheet C is controlled to be b by the conveyance control of tabbed transfer sheets, the interval length between normal image forming areas excluding the tab area is b' larger than b, as shown in FIG. 14. Accordingly, it is necessary to delay the timing of image forming to be applied to the area excluding the tab area, for the conveyance time corresponding to (b'-b). Also, for the tabbed transfer sheet C and the tabbed transfer sheet D, the interval length is c' larger than c, as shown in FIG. 14. Accordingly, it is necessary to delay the timing of image forming for the conveyance time corresponding to (c'-c). In such a manner, proper image forming is performed, corresponding to a recognized tabbed transfer sheet.

Figure 15:
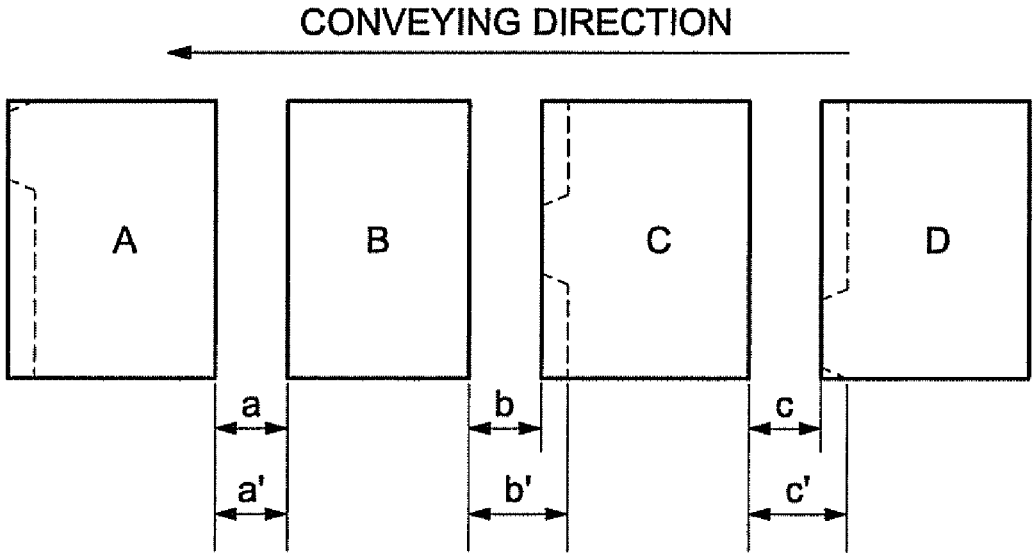
FIG. 15 is an illustration showing a state of unprocessed tabbed transfer sheet blanks used in the image forming apparatus.

Further, although the sheet conveyance interval length between the trailing end of the transfer sheet B and the leading end of the unprocessed tabbed transfer sheet blank C is b by the conveyance control of unprocessed tabbed transfer sheet blanks, the interval length between normal image forming areas excluding the unprocessed tab area is b' larger than b, as shown in FIG. 15. Accordingly, it is necessary to delay the timing of image forming to be applied to the area excluding the unprocessed tab area, for the conveyance time corresponding to (b'-b). Also, for the unprocessed tabbed transfer sheet blank C and the unprocessed tabbed transfer sheet blank D, the interval length is c' larger than c, as shown in FIG. 15. Accordingly, it is necessary to delay the timing of image forming for the conveyance time corresponding to (c'-c). In such a manner, proper image forming is performed, corresponding to a recognized unprocessed tabbed transfer sheet blank.

As a result, by using transfer sheets in respective colors detectable by the color detection sensor as tabbed transfer sheets or unprocessed tabbed transfer sheet blanks and storing the correspondence relationships between pieces of color information and pieces of tab information in the storage section, it is possible to perform suitable control of image forming and conveyance in a state that correct recognition is made on the tabbed transfer sheets or unprocessed tabbed transfer sheet blanks.

In a case, as shown in FIGS. 12 and 13, where conveyance control in association with a tab is not required, control of change in timing of image forming is not necessary, either.

The above described process including sheet feeding (step S2 in FIG. 3), conveyance control (steps S5 and S10 in FIG. 3) and image forming (steps S6, S12 and S13 in FIG. 3) is repeatedly executed for the number of transfer sheets having been set for the job in execution (N in step S14 in FIG. 3), and the process is terminated at the time image forming is completed for the set number of transfer sheets (Y in step S14 in FIG. 3).

In addition to the above, a process is executed as post-processing that trims the peripheral area of the unprocessed tab area of an unprocessed tabbed transfer sheet blank to form a tabbed transfer sheet. Herein, in a case where a device to execute the post-processing is connectable with the image forming apparatus, if the recognition section 104 has recognized that a transfer sheet is an unprocessed tabbed transfer sheet blank, based on color information detected by the color detection sensor 81, the control section 101 gives instruction to conduct tab processing.

Through this post-processing, the unprocessed tab area of the unprocessed tabbed transfer sheet blank (refer to FIG. 7*a*) remains as a tab, and the wasteful area around it is trimmed, thus forming a tabbed transfer sheet in the same shape and size as a regular tabbed transfer sheet (refer to FIG. 7*b*).

As described above, in the present embodiment, based on color information on a fed transfer sheet detected by the color detection sensor 81, the recognition section 104 recognizes whether the transfer sheet subjected to the detection by the color detection sensor is a non-tabbed transfer sheet having no tab, or either a tabbed transfer sheet having a tab or an unprocessed tabbed transfer sheet blank, the unprocessed tabbed transfer sheet blank being capable of being processed into a transfer sheet having a tab by post-processing. According to the recognition result, the control section 101 performs control of conveyance in a state maintaining a proper sheet conveyance interval length for the tabbed transfer sheet or the unprocessed tabbed transfer sheet blank, and further, performs control of image forming with proper timing associated with the control of conveyance in this state of maintaining the proper sheet conveyance interval length.

As a result, by the use of sheets in colors detectable by the color detection sensor 81 as tabbed transfer sheets or unprocessed tabbed transfer sheet blanks, image forming is performed with proper timing, while proper sheet conveyance interval length is maintained in a state of correct recognition of tabbed transfer sheets or unprocessed tabbed transfer sheet blanks.

That is, it is not necessary to provide a tab detection sensor with multiple devices as described in the above Patent Documents, and only a color detection sensor 81 with a single device is required. Accordingly, there is no problem of a complicated mechanism for installing a tab detection sensor of multiple devices, and it is not necessary to provide a detection circuit with multiple input ports for receiving detection results by a tab detection sensor with multiple devices.

Further, according to the present embodiment, it is possible to properly use unprocessed tabbed transfer sheet blanks which cannot be detected even by the use of a conventional tab detection sensor with multiple devices, wherein control of conveyance in a state of maintaining a proper sheet conveyance interval length and image forming with proper timing is realized.

Still further, in the present embodiment, relationships between pieces of color information and pieces of tab information inputted via the operation section 111 or an external device are stored in the storage section 103. The recognition section 104 recognizes the types of transfer sheets, with reference to the relationships stored in the storage section 103 and detection results by the color sensor 81, and the control section 101 performs control of image forming and conveyance in a state proper for tabbed transfer sheets or unprocessed tabbed transfer sheet blanks, based on the recognition results.

As a result, by using transfer sheets in colors detectable by the color detecting sensor 81 as tabbed transfer sheets or unprocessed tabbed transfer sheet blanks, and storing relationships between pieces of color information and pieces of tab information in the storage section 103, suitable control of image forming and conveyance is performed in a state of correct recognition of tabbed transfer sheets or unprocessed tabbed transfer sheet blanks.

Further, in the present embodiment, plural ejection sections 73 and 74 are provided in order to eject transfer sheets subjected to image forming. According to the types of transfer sheets recognized by the recognition section 104, the recognition being based on color information detected by the color detection sensor 81 and relationships stored in the storage section 103 between pieces of color information and pieces of tab information, the control section 101 performs control of switching the sorting of ejection of transfer sheets at the ejection sorting section 71.

As a result, by using transfer sheets in colors detectable by the color detecting sensor 81 as tabbed transfer sheets or unprocessed tabbed transfer sheet blanks, and by storing relationships between pieces of color information and pieces of tab information in the storage section 103, suitable control of image forming and transfer sheet conveyance and control of ejection are performed in a state of correct recognition of tabbed transfer sheets or unprocessed tabbed transfer sheet blanks. In other words, when an improper tabbed transfer sheet or improper unprocessed tabbed transfer sheet blank is fed, control is performed to eject the transfer sheet to a different ejection section, which prevents mixing of the improper transfer sheet into transfer sheets having been correctly subjected to image forming.

It is also possible to eject unprocessed tabbed transfer sheet blanks, distinguishing them from non-tabbed transfer sheets and tabbed transfer sheets. In this case, unprocessed tabbed transfer sheet blanks which need post-processing are ejected to a different ejection section so that the unprocessed tabbed transfer sheet blanks are sure to be subjected to post-processing.

Still further, in the present embodiment, input of tab-image-forming information regarding image forming on tabs via the operation section 111 or an external device is received and stored in the storage section 103, and the tab-image-forming information stored in the storage section 103 is referred to. Thus, the control section 101 performs control for image forming in the areas of tab sections of transfer sheets or in the areas to be processed into tabs (unprocessed tab areas) of transfer sheets.

As a result, by using transfer sheets in colors detectable by a color detecting sensor as tabbed transfer sheets or unprocessed tabbed transfer sheet blanks, by storing relationships between pieces of color information and pieces of tab information, and by storing tab-image-forming information in the storage section 103, proper control of image forming and conveyance is performed in a state of correct recognition of tabbed transfer sheets or unprocessed tabbed transfer sheet blanks and in association with image forming on tabs.

In the above embodiment, although colors in ordinary visible lights, such as chromatic colors and achromatic colors, have been taken as examples of colors of transfer sheets to be detected by the color sensor 81, the invention is not limited thereto, and fluoro components reactive to ultraviolet rays, a color gamut out of color recognition range by human-beings, and the like also may be employed. Further, a color is not required to be present in the entire area of a transfer sheet, and a predetermined position may be colored.

What is claimed is:

1. An image forming apparatus for use with a transfer sheet, comprising:

a sheet feeding unit structured to feed the transfer sheet;

a color detection sensor structured to detect color information on the transfer sheet fed from the sheet feeding unit;

a recognition section structured to recognize whether the transfer sheet subjected to the detection by the color detection sensor is a non-tabbed transfer sheet having no tab, or either a tabbed transfer sheet having a tab or an unprocessed tabbed transfer sheet blank, the unprocessed tabbed transfer sheet blank being capable of being processed into a tabbed transfer sheet having a tab by post-processing, wherein a recognition result is made based on the color information detected by the color detection sensor; and a control section that controls image forming on and conveying of the fed transfer sheet, according to the recognition result by the recognition section.

2. The image forming apparatus of claim 1, further comprising:

an information input section structured to receive input of multiple pieces of color information, and multiple pieces of tab information on respective types of transfer sheets, the types corresponding to the respective pieces of color information; and a storage section structured to store correspondence relationships between the pieces of color information and the pieces of tab information inputted via the information input section, wherein, the recognition section recognizes tab information on a fed transfer sheet, referring to color information detected by the color detection sensor and one of the correspondence relationships stored in the storage section; and the control section controls image forming on and conveying of the fed sheet, based on a recognition result on the tab information of the fed sheet by the recognition section.

3. The image forming apparatus of claim 2, wherein the pieces of tab information corresponding to the respective types include distinction between categories of non-tabbed transfer sheets, tabbed transfer sheets, and unprocessed tabbed transfer sheet blanks; and the pieces of tab information corresponding to the respective types of the tabbed transfer sheets or unprocessed tabbed transfer sheet blanks further include at least one of items being respective tab positions or unprocessed tab positions, tab widths or unprocessed tab widths, tab lengths or unprocessed tab lengths, and tab division numbers or unprocessed tab division numbers.

4. The image forming apparatus of claim 3, wherein the pieces of tab information corresponding to the respective types further include indication whether respective tab areas of the tabbed transfer sheets or respective unprocessed tab areas of the unprocessed tabbed transfer sheet blanks, the unprocessed tab areas being capable of being processed into tabs by post-processing, are located at respective leading ends, with respect to a transfer sheet conveying direction, at respective trailing ends, or at respective side ends perpendicular to the conveying direction.

5. The image forming apparatus of claim 2, further comprising:

a plurality of ejection sections structured to eject a transfer sheet subjected to image forming, wherein the control section controls switching of sorting of ejection of transfer sheet to the ejection sections, based on respective recognition results by the recognition section.

6. The image forming apparatus of claim 5, wherein:

the information input section receives input of pieces of tab information designated for respective page positions;

the control section switches sorting of ejection of each of the transfer sheets when feeding the transfer sheet for the respective page position, depending on whether or not the tab information designated for the page position through input via the input section and tab information on the fed transfer sheet recognized by the recognition section accord with each other; and if the inputted information and the recognized information do not accord with each other, then the control section ejects the fed transfer sheet to one of the ejection sections, the one being used to eject a transfer sheet not to be subjected to image forming.

7. The image forming apparatus of claim 6, wherein, if the inputted tab information and recognized tab information on the fed transfer sheet accord with each other, then the control section further switches sorting of ejection of the fed transfer sheet, depending on whether the fed transfer sheet is an unprocessed tabbed sheet blank, or either a non-tabbed transfer sheet or a tabbed transfer sheet.

8. The image forming apparatus of claim 2, wherein the storage section receives input of tab-image-forming information on image forming on a tab from the information input section or an external device and stores the tab-image-forming information; and the control section performs control to form an image on a tab area or unprocessed tab area of a transfer sheet, referring to the tab-image-forming information stored in the storage section, the unprocessed tab area being capable of being processed into a tab by post-processing.

9. The image forming apparatus of claim 1, wherein the color detection sensor is disposed such as to be able to detect color information on a fed transfer sheet prior to image forming thereon.

10. The image forming apparatus of claim 9, wherein the color detection sensor further serves as an end detection sensor structured to detect an end in the conveying direction of the transfer sheet.

11. The image forming apparatus of claim 10, wherein the control of conveying comprises control of a sheet feeding interval length, and the control of image forming comprises synchronization between sheet feeding under the control of the sheet feeding interval length and image forming.

12. The image forming apparatus of claim 1, wherein the color detection sensor further serves as an end detection sensor structured to detect either a leading end or a trailing end of the transfer sheet.

13. The image forming apparatus of claim 1, wherein the control of conveying comprises control of a sheet feeding interval length, and the control of image forming comprises synchronization between sheet feeding under the control of the sheet feeding interval length and image forming.

* * * * *